US007037168B2

(12) United States Patent
Wu

(10) Patent No.: US 7,037,168 B2
(45) Date of Patent: May 2, 2006

(54) REMOVABLE GAME TRAY FOR BABY WALKERS

(76) Inventor: Jung-Jyh Wu, P.O. Box 82-144, Taipei (TW)

( * ) Notice: Subject to any disclaimer, the term of this patent is extended or adjusted under 35 U.S.C. 154(b) by 351 days.

(21) Appl. No.: 10/608,159

(22) Filed: Jun. 30, 2003

(65) Prior Publication Data

US 2004/0262955 A1 Dec. 30, 2004

(51) Int. Cl.
*A63H 33/00* (2006.01)

(52) U.S. Cl. ..... 446/227; 446/258

(58) Field of Classification Search ..... 446/227, 446/247, 175, 484, 429, 430, 258, 259; 297/136, 297/137

See application file for complete search history.

(56) References Cited

U.S. PATENT DOCUMENTS 5,709,582 A * 1/1998 O'Donnell ..... 446/227
6,132,283 A * 10/2000 O'Donnell et al. ..... 446/227
6,547,628 B1 * 4/2003 Long ..... 446/227
6,715,826 B1 * 4/2004 Bellows et al. ..... 297/136
6,802,757 B1 * 10/2004 Sejnowski ..... 446/227

* cited by examiner

*Primary Examiner*—Kien Nguyen
(74) *Attorney, Agent, or Firm*—Leong C. Lei

(57) ABSTRACT

A removable game tray for baby walkers which includes a main tray including an upper cover and a lower cover which is fixedly mounted on the upper cover, the lower cover having two tongues at one side thereof and two rails at a bottom thereof, a handle slidably engaged with the rails and having a top protruded out of the lower cover when pushed into the lower cover, and a receptacle having a recess configured to receive the main tray, the recess having an opening adapted to engage with the top of the handle, the recess being cut by two grooves to form two lugs each having a hole, the hole being adapted to receive a respective one of the tongues, whereby the main tray can be easily removed from the receptacle by pressing the lugs.

4 Claims, 7 Drawing Sheets

REMOVABLE GAME TRAY FOR BABY WALKERS

BACKGROUND OF THE INVENTION

1. Field of the Invention

This invention is related to a removable game tray for a baby walker, and in particular to one which includes a main tray and a receptacle, so that the main tray and the receptacle can be installed conveniently, thereby providing a multi-purpose game tray for the infant.

2. Description of the Prior Art

The conventional baby walker generally has a front tray which has a recess for mounting a game tray on which toys can be affixed, so that when the switches of the toys are triggered, the electronic device within the game tray will produce music, ringing, or the like. When the infant sits in the baby walker the game tray can provide entertainment for the infant. However, the game tray is fixedly mounted in the front tray of the conventional baby walker, so that it cannot be removed, and thereby limiting its use.

SUMMARY OF THE INVENTION

It is the primary object of the present invention to provide a removable game tray for baby walkers includes a main tray including an upper cover and a lower cover which is fixedly mounted on the upper cover, the lower cover having two tongues at one side thereof and two rails at a bottom thereof, a handle slidably engaged with the rails and having a top protruded out of the lower cover when pushed into the lower cover, and a receptacle having a recess configured to receive the main tray, the recess having an opening adapted to engage with the top of the handle, the recess being cut by two grooves to form two lugs each having a hole, the hole being adapted to receive a respective one of the tongues, whereby the main tray can be easily removed from the receptacle by pressing the lugs.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
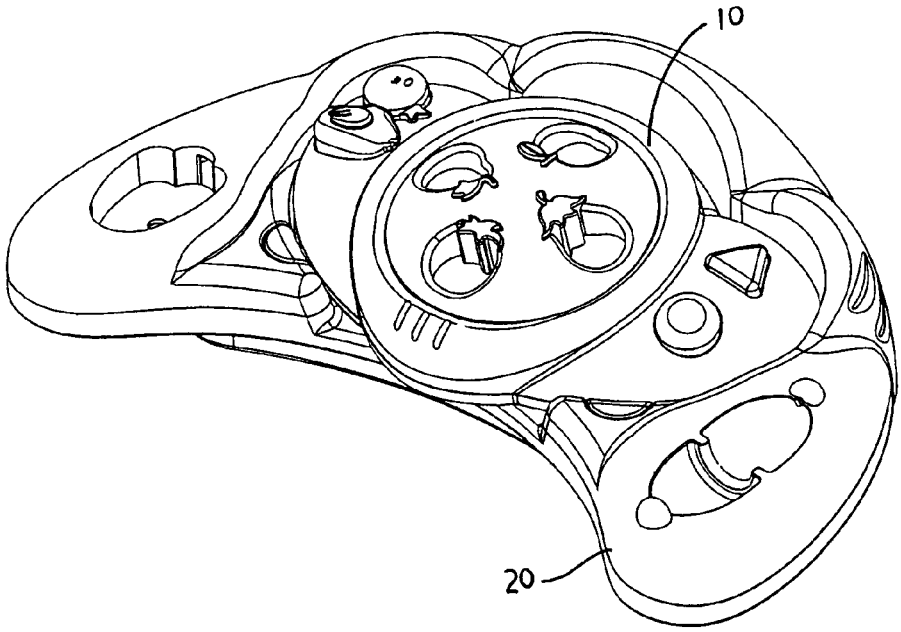
FIG. 1 is a perspective view of the present invention.

With reference to FIG. 1, the game tray according to the present invention basically comprises a main tray 10 and a receptacle 20.

Figure 2:
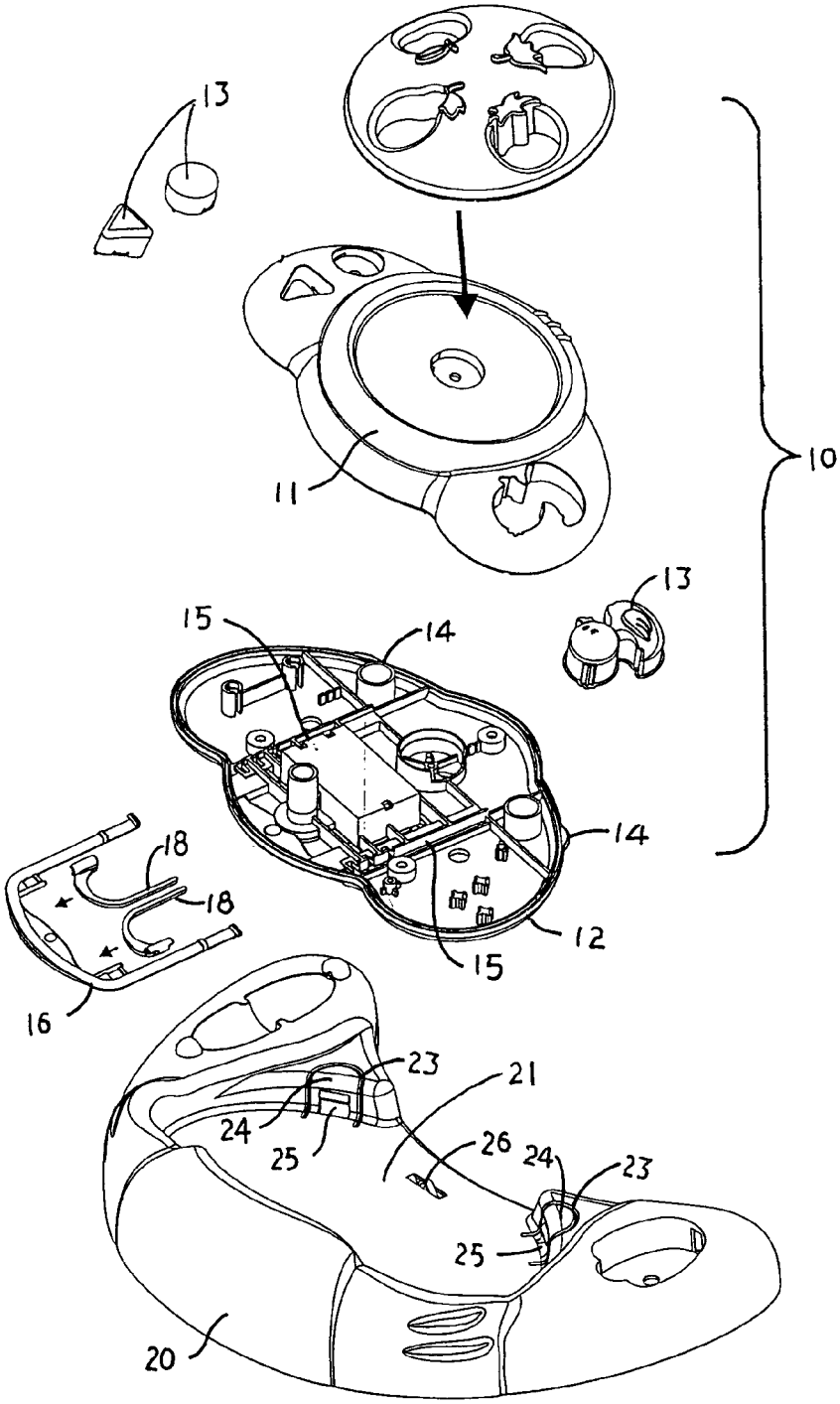
FIG. 2 is an exploded view of the present invention.
Figure 3:
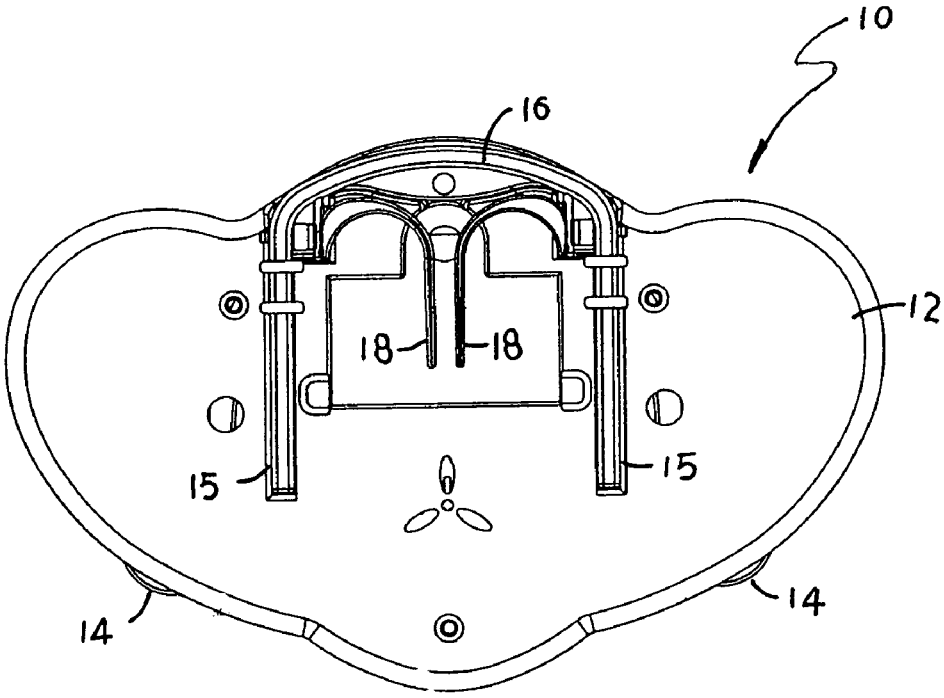
FIG. 3 is a top plan view of the main tray.
Figure 4:
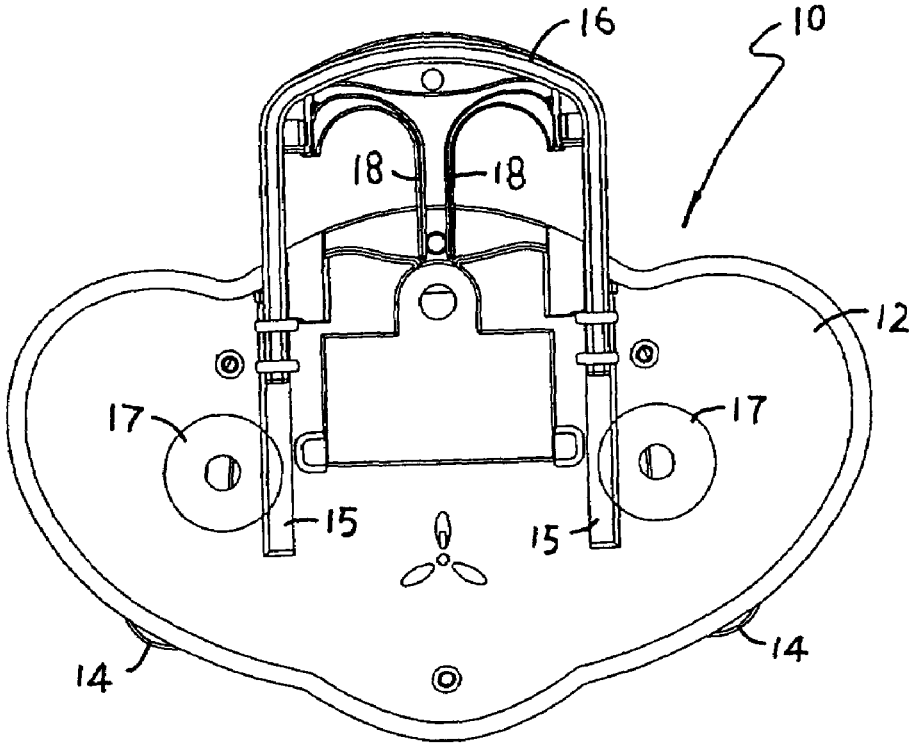
FIG. 4 is a top plan view of the main tray with the handle extended.

Referring to FIGS. 2 and 3, the main tray 10 comprises a upper cover 11 and a lower cover 12, which are fixedly mounted together by bolts, tenons or the like. The top of the upper cover 11 can be mounted with toys and buttons 13, so that when the buttons are depressed, the electronic device will produce pleasant ringing and music. The lower cover 12 is provided with two tongues 14, and two rails 15. The two rails 15 are designed for engaging with a handle 16, so that the handle 16 can be pulled out of the lower cover 12, along the rails 15. The bottom of the lower cover is provided with a plurality of suckers 17 (see FIG. 4). The handle 16 is provided with two hooks 18.

Figure 6:
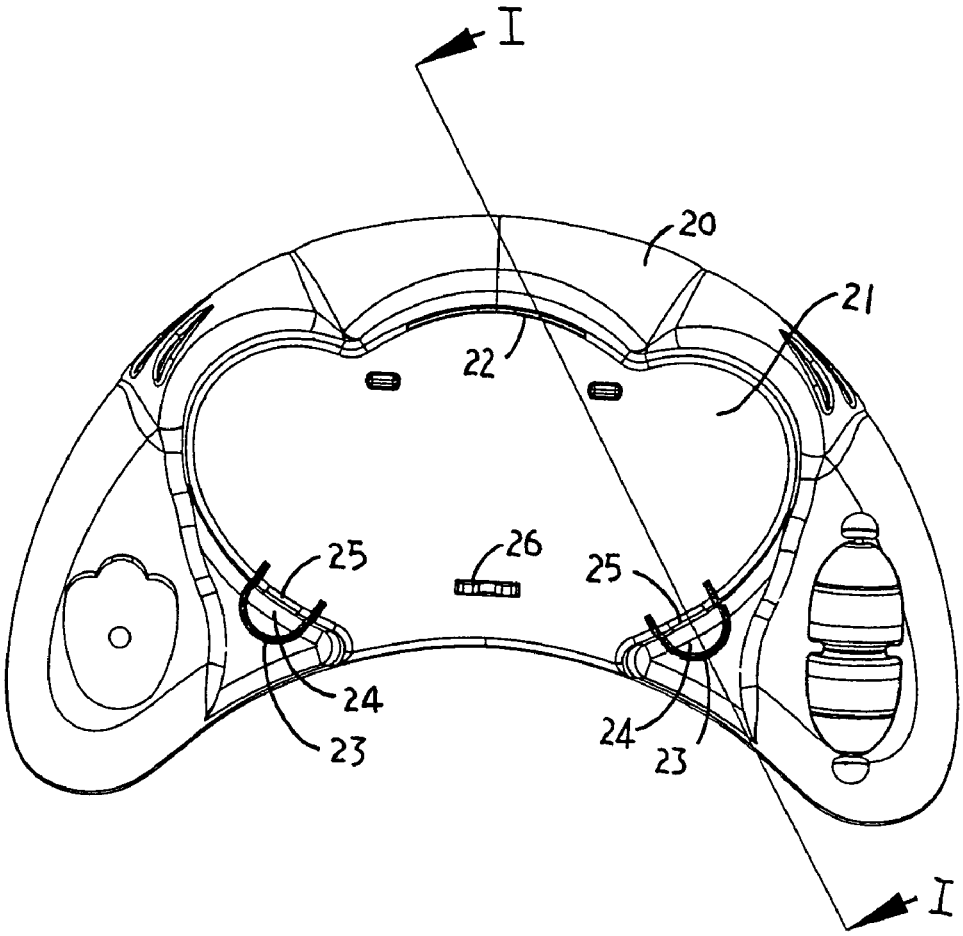
FIG. 6 is a top plan view of the receptacle.

Referring to FIGS. 2 and 6, the receptacle 20 is to be mounted on a tray of a baby walker The receptacle 20 is formed with a recess 21 which is configured to receive the main tray 10. The recess 21 has an opening 22 and is cut by two grooves 23 to form two receding lugs. The lower portion of the lug 24 has an opening 25 so that when the lug 24 is pressed, the hole 25 will be enlarged The bottom of the recess 21 is provided with a retractable spring 26, the upper end of which protrudes out of the recess 21.

Figure 5:
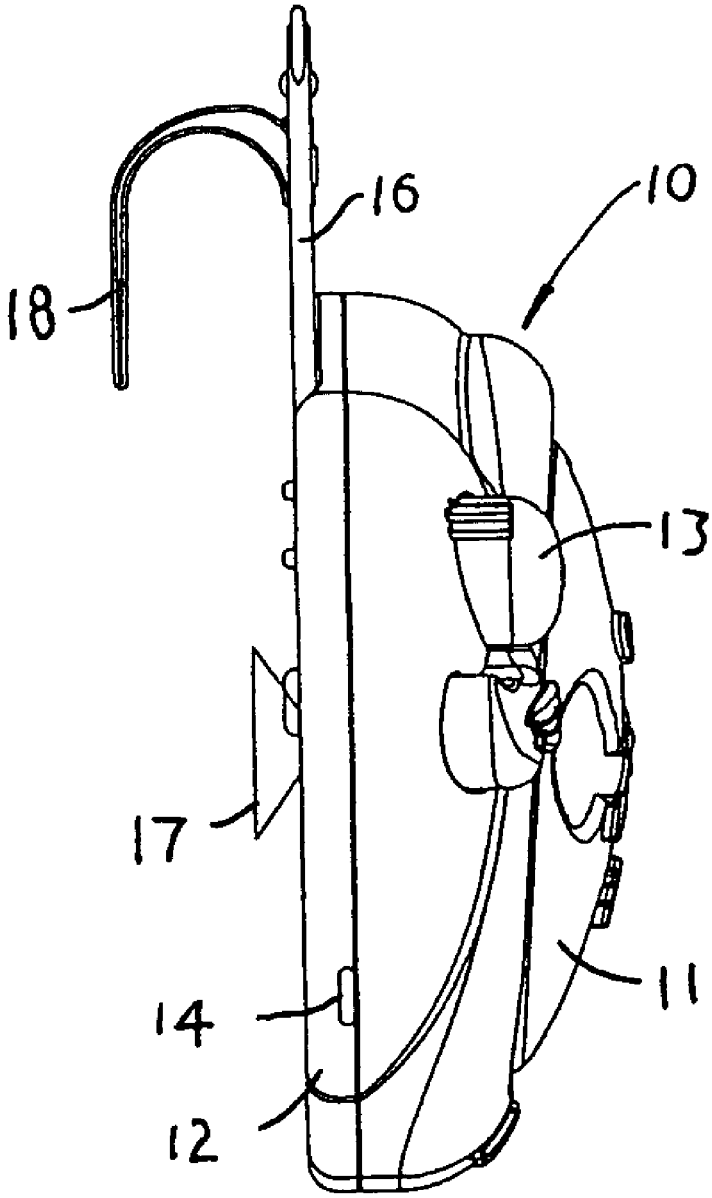
FIG. 5 is a side view of the main tray.
Figure 7:
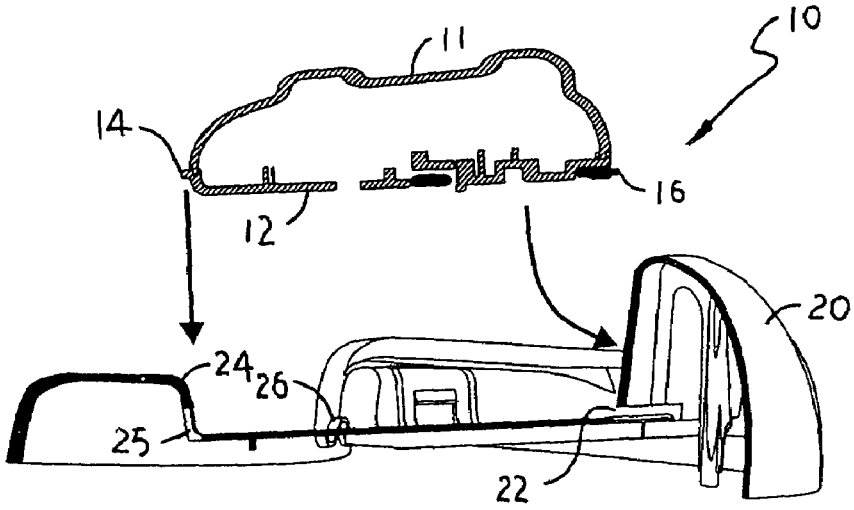
FIG. 7 is a sectional view taken along line I—I of FIG. 6.
Figure 8:
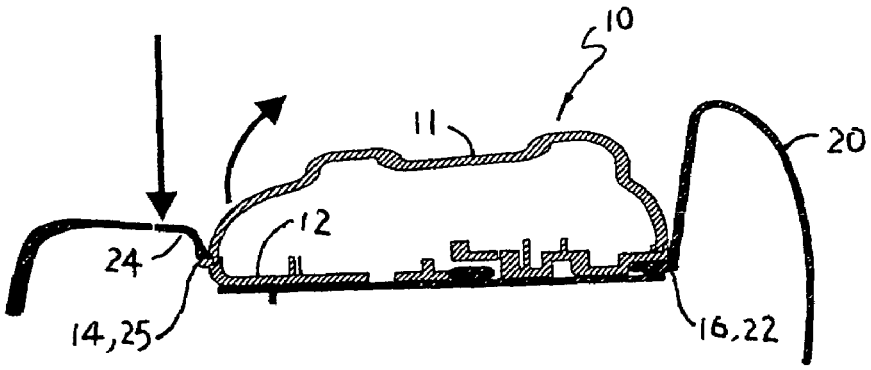
FIG. 8 illustrates the engagement between the main tray and the receptacle.

As the lower cover 12 of the main tray 10 is provided with two tongues 14, and the handle 16 will slightly protrude out of the lower cover 12, there will be three points for engaging with the receptacle 20. In assembly, the top of the handle 16 is first engaged with the opening 22 of the receptacle 20, and then the main tray 10 is pressed downward to engage the tongues 14 with the holes 25 of the lugs 24, so that the main tray 10 is firmly mounted in the recess 21 of the receptacle 20 (see FIG. 7). Accordingly, the game tray consisting of the main tray 10 and the receptacle 20 can provide entertainment, games and learning for the infant sitting in the baby walker. When the infant does not sit in the baby walker, the lugs 24 of the receptacle 20 can be pressed to enlarge the hole 25, thereby disengaging the tongues 14 of the main tray 10 with the hole 25. Then, the retractable spring 26 will move the main tray 10 upwardly, so that the main tray 10 can be removed from the receptacle 20 for use (see FIGS. 5 & 8). The main tray 10 can be provided with colorful toys or provided with music producing toys, and the user can hold the handle 16 to carry the main tray. As the bottom of the lower cover 12 of the main tray 10 is provided with a plurality of suckers 17, the main tray 10 can be easily affixed to the wall or on a table top. Alternatively, the two hooks 18 of the handle 16 can be used to hang the main tray 10 on a baby's bed, cabinet, window, to provide entertainment for the infant.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A removable game tray for baby walkers comprising:

a main tray including an upper cover and a lower cover which is fixedly mounted on said upper cover, the lower cover having two tongues at one side thereof and two rails at a bottom thereof, a handle slidably engaged with said rails and having a top protruded out of said lower cover when pushed into said lower cover; and a receptacle having a recess configured to receive said main tray, said recess having an opening adapted to engage with said top of said handle, said recess being cut by two grooves to form two lugs, each of said lugs having a hole, said hole being adapted to receive a respective one of said tongues;

whereby said main tray can be easily removed from said receptacle by pressing said lugs.

2. The removable game tray for baby walkers as claimed in claim 1, wherein said lower cover of said main tray is provided with a plurality of suckers.

3. The removable game tray for baby walkers as claimed in claim 1, wherein said handle is provided with two hooks.

4. The removable game tray for baby walkers as claimed in claim 1, wherein said recess of said receptacle is provided with a retractable spring which has a top extending out of said recess.

* * * * *